United States Patent [19]

Van Besouw et al.

[11] 4,066,928

[45] Jan. 3, 1978

[54] RESONANT CAVITY MAGNETRON HAVING A HELICAL CATHODE

[75] Inventors: Joannes Baptista Maria Adrianus Van Besouw; Egbert Bernardus Gretinus Willem Gotjé; Franciscus Napoleon Adrianus Kerstens, all of Eindhoven, Netherlands

[73] Assignee: U.S. Philips Corporation, New York, N.Y.

[21] Appl. No.: 681,792

[22] Filed: Apr. 30, 1976

[30] Foreign Application Priority Data

May 20, 1975 Netherlands ..... 7505871

[51] Int. Cl.² ..... H01J 25/50

[52] U.S. Cl. ..... 315/39.51; 313/341; 313/346 R; 315/39.77

[58] Field of Search ..... 315/39.51, 39.53, 39.77; 313/337, 341, 346

[56] References Cited

U.S. PATENT DOCUMENTS

| | | | |
|---|---|---|---|
| 3,290,941 | 12/1966 | Goodman | 313/337 X |
| 3,465,201 | 9/1969 | Dorgelo | 315/39.51 |
| 3,846,667 | 11/1974 | Hisada et al. | 315/39.51 |
| 3,944,872 | 3/1976 | Wilbur et al. | 315/39.51 |
| 3,988,636 | 10/1976 | Sato et al. | 315/39.51 |

*Primary Examiner*—Saxfield Chatmon, Jr.
*Attorney, Agent, or Firm*—Frank R. Trifari

[57] ABSTRACT

Each of the ends of a helical cathode for a magnetron are connected to the respective end plate and supporting rod by a single collective weld.

3 Claims, 3 Drawing Figures

RESONANT CAVITY MAGNETRON HAVING A HELICAL CATHODE

The invention relates to a resonant cavity magnetron having a helical cathode which is secured to two end plates which are supported by supporting rods.

In known magnetrons, the end plate at the free end of the cathode is supported by a central supporting rod and the end plate at the non-free end is supported by two supporting rods extending diametrically relative to the central supporting rod. The rods also serve as filament current conductors. In these cathodes the supporting rods are secured to the end plates by welding and the cathode is secured to the end plates by soldering. This requires a large number of processing steps so that the price is high.

In the construction of the magnetron described in German Patent Application 1,491,380 laid open to public inspection, the cathode at the non-free end is secured to an axially directed pin which is secured to a supporting cylinder near the transition of the end plate to said cylinder. At the free end the cathode is incorporated in a manner not shown in a cross section of the central pin. This construction is also complicated.

It is the object of the invention to provide a simpler construction.

According to the invention, in a resonant cavity magnetron having a helical cathode which is secured to two end plates supported by supporting rods, the two cathode ends with the end plates and the associated single supporting rods are each connected by one collective weld, the cathode extending tangentially at the non-free end and being bent towards the axis at the free end. The cathode end preferably engages around the central supporting rod.

Because the number of operations in constructing the cathode is small and no solder is used, the price may be low and the possibility of an incorrectly directed cathode relative to the axis of the magnetron is also small.

Figure 1:
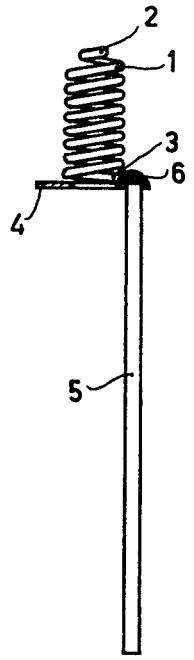
Figure 2:
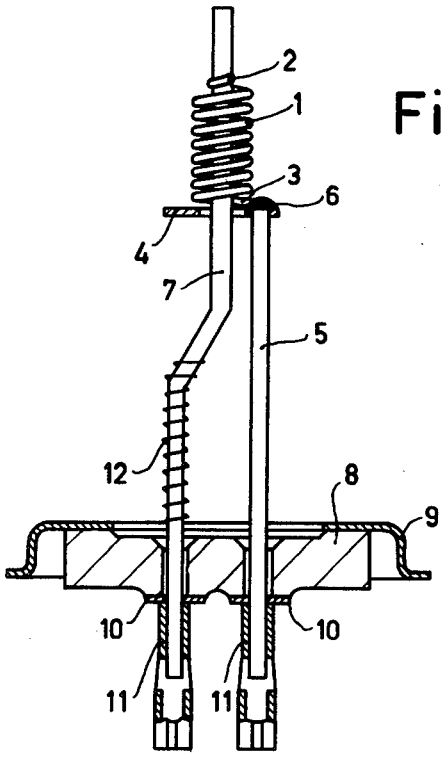
Figure 3:
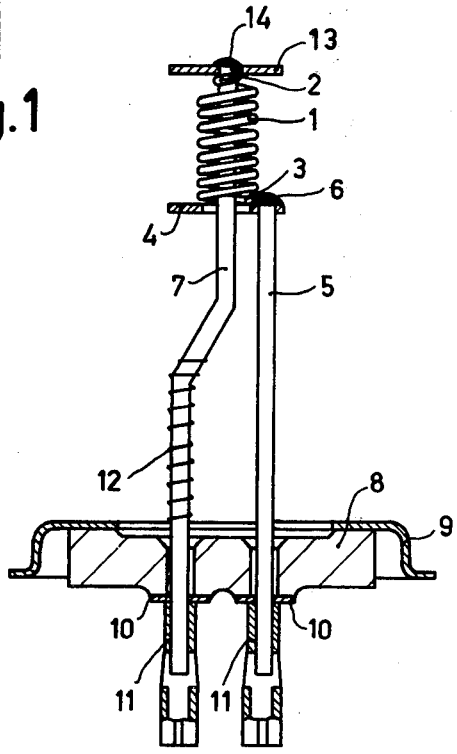

The invention will be described in greater detail with reference to the drawing in which the FIGS. 1 to 3 show a cathode for a magnetron according to the invention in a number of stages of manufacture.

Reference numeral 1 in FIG. 1 denotes the tungsten thorium filament, wire thickness 0.7 mm, diameter 5 mm, length 11 mm. The cathode has an inwardly bent upper end 2 and a tangentially extending lower end 3. The end 3 is connected to the molybdenum end plate 4 and the molybdenum supporting rod 5 by means of one single arc weld 6. When making the weld 6, the three parts are held in a jig. After making the weld 6 the central supporting rod 7 is inserted into the cathode so that the inwardly bent end 2 engages around the rod 7 (FIG. 2) that is, the end 2 of the cathode encircles the rod 7 in contacting relationship.

The parts 1, 4, 5 and 7 are placed in a jig together with the alundum plate 8 which is in the fernico tube cap 9. The cathode is aligned into jig relative to the cap 9 so that a possible inclined position of the rods 5 and 7 has no influence on the position of the cathode in the anode system. As a matter of fact, the tube cap 9 is accurately fitting relative to the anode system. In a mixture of nitrogen-hydrogen the rods 5 and 7 are soldered to the plate 8 by means of the copper rings 10 and the plate is soldered to the cap 9 by means of copper silver solder. The copper sleeves 11 are simultaneously soldered to the rods 5 and 7 as a filament cathode connection. After the soldering operation a zirconium wire 12 is wound near the end 2 of the cathode between the turns around the rod 7 and moved in the direction of the cap 9.

The end plate 13 (FIG. 3) is then moved around the rod 7 and the weld 14 between 7, 2 and 3 is made in a jig. After carbonizing the cathode 1 the zirconium wire 12 is moved to within the cathode and the assembly is ready for being mounted in the anode system of the magnetron. During operation of the magnetron the zirconium wire 12 attains a high temperature and can hence easily take up gases.

What is claimed is:

1. In a resonant cavity magnetron having a helical cathode having two ends being secured to two end plates which are supported by respective supporting rods, the improvement wherein each one of the two cathode ends is connected with a respective end plate and one of the associated supporting rods by a single collective weld, the cathode extending tangentially at its non-free end and being bent towards the axis at its free end.

2. A resonant cavity magnetron as claimed in claim 1, wherein one of the supporting rods extends through said cathode, and the free end of the cathode encircles said one supporting rod in contacting relationship.

3. A resonant cavity magnetron as claimed in claim 1, wherein one supporting rod extends through said helical cathode, and a gettering wire is wound around said one supporting rod within the cathode.

* * * * *